US008070074B2

(12) United States Patent
Craig

(10) Patent No.: US 8,070,074 B2
(45) Date of Patent: Dec. 6, 2011

(54) BATHING APPARATUS AND METHOD OF USING SAME

(76) Inventor: William Richard Craig, Toronto (CA)

( * ) Notice: Subject to any disclaimer, the term of this patent is extended or adjusted under 35 U.S.C. 154(b) by 623 days.

(21) Appl. No.: 12/113,019

(22) Filed: Apr. 30, 2008

(65) Prior Publication Data

US 2009/0272449 A1 Nov. 5, 2009

(51) Int. Cl.
*B05B 7/26* (2006.01)

(52) U.S. Cl. ..... 239/310; 239/74; 239/313; 239/318; 239/321; 239/333; 239/373; 239/432; 4/903

(58) Field of Classification Search ..... 239/71, 239/74, 302–304, 310, 313, 315, 318, 329, 239/331, 333, 525, 530, 282, 320, 321, 373, 239/432; 222/132; 4/903, 596, 597, 605
See application file for complete search history.

(56) References Cited

U.S. PATENT DOCUMENTS

| | | | | |
|---|---|---|---|---|
| 1,220,704 | A | 3/1917 | Swimmer | |
| 1,616,514 | A | 2/1927 | Swimmer | |
| 2,201,528 | A | 5/1940 | Freng | |
| 2,907,528 | A | 10/1959 | Lambton | |
| 3,052,417 | A | 9/1962 | Daniel | |
| 3,106,345 | A | 10/1963 | Wukowitz | |
| 3,134,545 | A | 5/1964 | Armond | |
| 3,199,788 | A | 8/1965 | Davis | |
| 3,713,585 | A * | 1/1973 | Conklin | 239/310 |
| 3,720,352 | A | 3/1973 | Kozlowski | |
| 3,763,888 | A | 10/1973 | Duecker | |
| 3,847,354 | A | 11/1974 | Lemond | |
| 3,917,172 | A | 11/1975 | O'Hare | |
| 4,019,658 | A * | 4/1977 | Consaul | 4/903 |
| 4,027,822 | A | 6/1977 | Usher | |
| 4,085,868 | A | 4/1978 | Blair | |
| 4,121,773 | A | 10/1978 | Headen et al. | |
| 4,189,100 | A | 2/1980 | Karp | |
| 4,218,013 | A | 8/1980 | Davison | |
| 4,295,612 | A * | 10/1981 | Betsinger et al. | 239/310 |
| 4,432,105 | A | 2/1984 | Pitroda | |
| 4,607,793 | A | 8/1986 | Eberle | |
| 4,623,095 | A | 11/1986 | Pronk | |
| 4,840,311 | A | 6/1989 | Shamblin | |
| 5,004,158 | A | 4/1991 | Halem et al. | |
| 5,071,070 | A | 12/1991 | Hardy | |
| 5,333,789 | A | 8/1994 | Garneys | |
| 5,339,469 | A | 8/1994 | Gilles | |

(Continued)

FOREIGN PATENT DOCUMENTS

| | | |
|---|---|---|
| CA | 1043107 | 11/1978 |

(Continued)

*Primary Examiner* — Steven J Ganey
(74) *Attorney, Agent, or Firm* — Jerry R. Potts

(57) ABSTRACT

A bathing apparatus includes an in-line mixing unit and a hand operated injecting unit. The mixing unit is coupled between a water supply pipe and a water dispensing device, such as a showerhead and is in fluid communication with the hand operated injection unit. The injection unit, upon user demand, draws a controllable predetermined quantity of bathing fluid from a standard off the shelf purchased bottle of bathing fluid, such as a bottle of bath oil, and then ejects, upon user demand and in a hands free operation, the drawn bathing fluid, at a user selected flow rate. The ejected bathing fluid passes to the mixing unit which causes the ejected bathing fluid to be mixed within a stream of water being delivered to the water dispensing device.

23 Claims, 7 Drawing Sheets

U.S. PATENT DOCUMENTS

| | | | | |
|---|---|---|---|---|
| 5,344,047 | A | 9/1994 | Chen | |
| 5,356,076 | A | 10/1994 | Bishop | |
| 5,507,413 | A | 4/1996 | Chen | |
| 6,006,374 | A | 12/1999 | Winnett et al. | |
| 6,038,715 | A | 3/2000 | Flieger et al. | |
| 6,647,566 | B1 | 11/2003 | Wang | |
| 6,651,851 | B2 | 11/2003 | Muderlak et al. | |
| 6,829,790 | B2 | 12/2004 | Petrovic et al. | |
| 6,859,955 | B2 | 3/2005 | Hudson | |
| 6,923,384 | B2 | 8/2005 | Cernik | |
| 6,926,212 | B1 * | 8/2005 | Glass | 239/318 |
| 7,082,948 | B2 | 8/2006 | Laughlin | |
| 7,155,758 | B1 | 1/2007 | Berke et al. | |
| 7,320,438 | B1 * | 1/2008 | Latin et al. | 239/310 |
| 2003/0094510 | A1 | 5/2003 | Laughlin | |

FOREIGN PATENT DOCUMENTS

| | | |
|---|---|---|
| CA | 2252226 | 4/2000 |
| CA | 2543313 | 5/2004 |

* cited by examiner

BATHING APPARATUS AND METHOD OF USING SAME

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

The present invention is related to bathing apparatus and more particularly, is related to a bathing apparatus which causes a bathing fluid, such as bath oil, shower qel, body wash, liquid soap, or moisturizer to be mixed with a stream of water and delivered to a water dispensing device, such as a showerhead.

SUMMARY OF THE INVENTION

A bathing apparatus includes an in-line mixing unit and a hand operated injecting unit. The mixing unit is coupled between a water supply pipe and a water dispensing device, such as a showerhead and is in fluid communication with the hand operated injection unit. The injection unit, upon user demand, draws a controllable predetermined quantity of bathing fluid from a standard off the shelf purchased bottle of bathing fluid, or a reservoir, and then ejects, upon user demand and in a hands free operation, the drawn bathing fluid, at a user selected flow rate. The ejected bathing fluid passes to the mixing unit which causes the ejected bathing fluid to be mixed within a stream of water being delivered to the water dispensing device.

DETAILED DESCRIPTION

Figure 1:
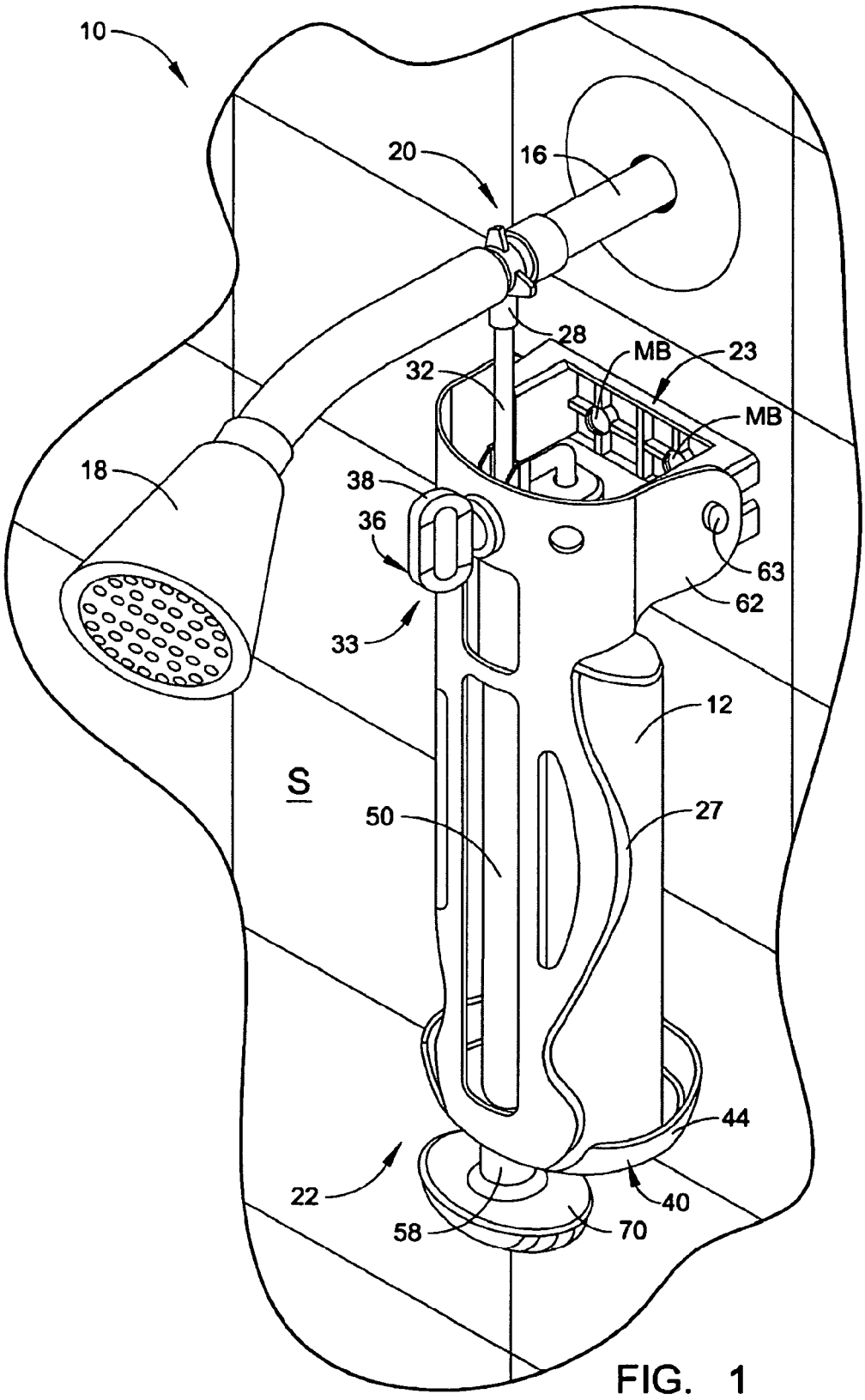
FIG. 1 is a pictorial view illustrating an installed bathing apparatus which is constructed in accordance with a preferred embodiment of the present invention.

Referring now to the drawings and more particularly to FIG. 1 thereof, there is illustrated a bathing apparatus 10, which is constructed in accordance with one preferred embodiment of the present invention. As best seen in FIG. 1, the bathing apparatus 10 is adapted to be utilized in a conventional shower stall S with any of a number of standard commercially available bottles of bathing fluid 14, such as a bottle 12 of a moisturizer or bathing oil 14. In this regard, the bathing apparatus 10 when installed and loaded with a conventional bottle 12 or a custom fitted open top reservoir of bathing fluid 14, causes under user demand a predetermined quantity of the bathing fluid 14 to be delivered to and mixed with a stream of water travelling from a water pipe 16 to a water dispensing unit 18, such as a showerhead. More particularly, the bathing apparatus 10 is adapted to be attached in-line between a showerhead water pipe 16 and a water dispensing unit 18 or showerhead 18 to allow a user to mix the bathing fluid 14 into the water stream traveling to the water dispensing unit 18—at a time, in an amount, at a rate, with hands-free, with a substantially consistent concentration and for a duration easily and automatically controlled by the user without the need of pouring and/or screwing tight fitting reservoirs or lids. In this regard, the user simply removes the lid or cap attached to the standard bottle 12 of bathing fluid 14, places the open bottle 12 of bathing fluid 14 into the bathing apparatus 10 so the bottle 12 of bathing fluid 14 is in fluid communication with the bathing apparatus 10, and then when ready, activates the bathing apparatus 10 to allow a user controllable, predetermined quantity of bathing fluid 14 to be drawn from the bottle 12 and injected into the stream of water traveling to the water dispensing unit 18.

Considering now the bathing apparatus 10 in greater detail with reference to FIG. 1, the bathing apparatus 10 generally includes a top unit or an in-line mixing unit 20 and a bottom unit or hand operated injection unit 22 which are in fluid communication with one another. The in-line mixing unit 20, which is mounted near the bottom unit 22, is coupled between a water supply pipe, such as the water supply pipe 16 and a water dispensing device or unit, such as a showerhead 18. This mounting and coupling arrangement facilitates the mixing of a bathing fluid, such as bath oil 14, as ejected from the injection unit 22, into a stream of water flowing from the water supply pipe 16 to the showerhead 18. This mixing operation is accomplished in a hands free operation which is an important feature of the present invention. The hands free operation is important since a user may utilizes his or her hands to scrub or smooth on the water and fluid mixture as it is delivered from the showerhead 18, while adjusting his or her body position relative to the stream of fluid flowing from the showerhead 18 to apply the mixture where desired. Also as will be explained hereinafter in greater detail, the user may also visually observe the operation of the injection unit 22 as it is injecting fluid to make a visual determination of how much time and what quantity of bathing fluid will continue to be delivered in a current fluid delivery operation. In summary then, the hand operated injection unit 22, upon user demand, forces a user controllable or user selected predetermined quantity of the bathing fluid to be delivered to the in-line mixing unit 20 for subsequent enjoyment by the user.

Considering now the in-line mixing unit 20 in greater detail with reference to FIGS. 1-7, the in-line mixing unit 20 is an elongated coupling unit. The in-line mixing unit 20 defines a main water stream path P for receiving and passing a stream of water from the water pipe 16 to the water dispensing device or showerhead 18. The in-line mixing unit 20 also is provided with an inlet area indicated generally at 28 for facilitating the introduction of, a stream of bathing fluid 14 from the injection unit 22, into the stream of water passing through the mixing unit 20. As will be explained hereinafter in greater detail, the mixing unit 20 receives a stream of bathing fluid 14 from the injection unit 22, which stream of bathing fluid 14 is mixed into the stream water at about a turbulent point TP within the mixing unit 20. Because the flow of water at the turbulent point TP is violently agitated or disturbed, where local velocities and pressures fluctuate randomly, the bathing fluid 14 is thoroughly mixed within the stream of water.

Figure 6:
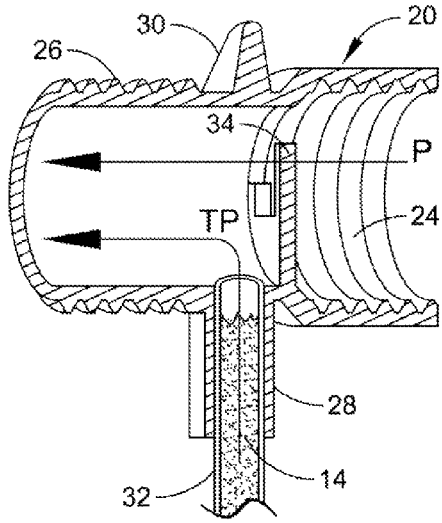
FIG. 6 is a diagrammatic view illustrating the flow of fluids through the mixing unit of FIG. 2A.

In order to facilitate connecting the in-line mixing unit 20 between the water pipe 16 and the showerhead 18, one end of the in-line mixing unit 20 is provided with a threaded female coupling 24 (FIG. 6) to couple the in-line mixing unit 20 to the water supply pipe 16, while the other end of the in-line mixing unit 20 is provided with a threaded male coupling 26 to couple the in-line mixing unit 20 to the showerhead 18. In order to help a user with the task of interconnecting the mixing unit 20 between the water pipe 16 and the showerhead 18, the mixing unit 20 is also provided with a set of outwardly projecting finger-engagable rib or fin members, which are generally indicated at 30. The finger-engagable rib or fin members 30 are equally spaced apart and distributed about the circumference of the mixing unit 20 at or about midway between the threaded female coupling 24 and the threaded male coupling 26 as best seen in FIG. 6.

Extending laterally or perpendicularly from the inlet area 28, is a flexible hose or conduit 32 which defines a flow path for receiving and passing the stream of bathing fluid 14 from the injection unit 22 to the mixing unit 20. The hose 32 has a sufficient length to provide a coupling between the mixing unit 20 and the injection unit 22. Also in order to help control the rate of flow of bathing fluid 14 traveling along the outflow path, the bathing apparatus 10 is provided with a rate control valve 33 which limits the flow rate of bathing fluid flowing along the outflow path from a maximum flow rate to a minimum flow rate, where the flow rate selected is a user selected flow rate.

Figure 2:
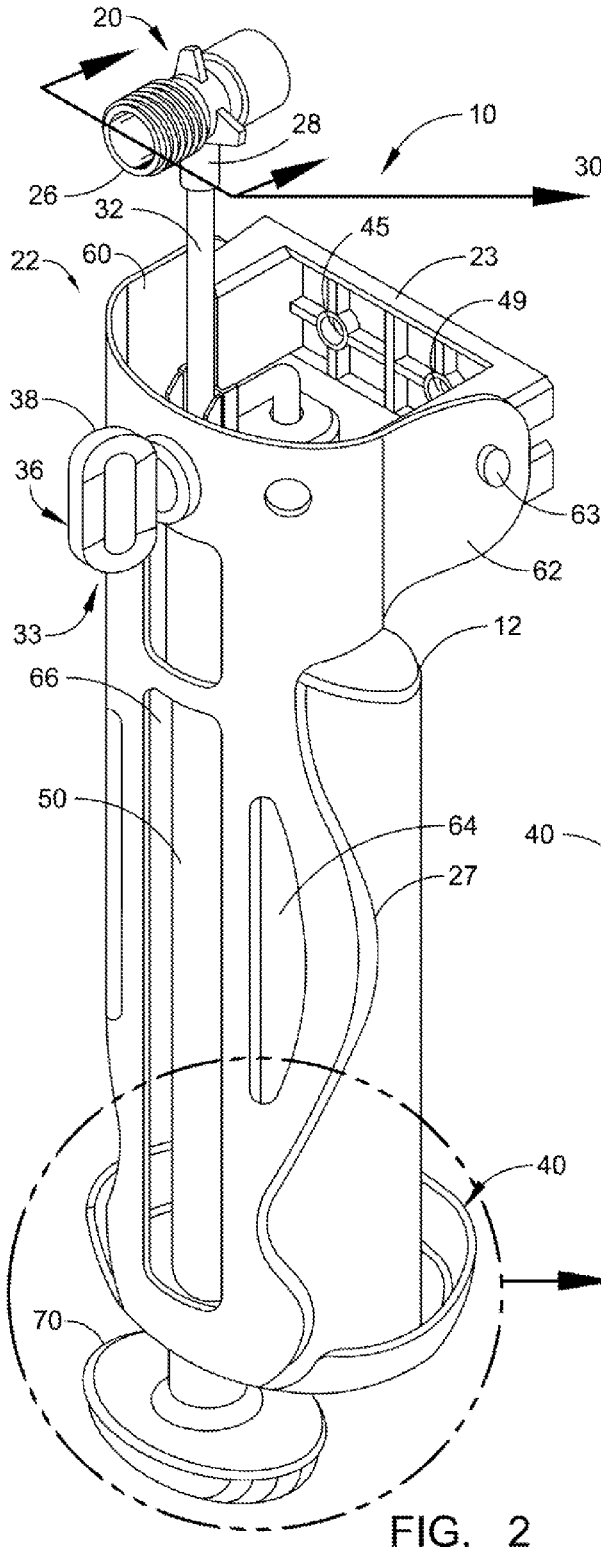
FIG. 2 is a pictorial view illustrating the bathing apparatus prior to installation as shown in FIG. 1.
Figure 2A:
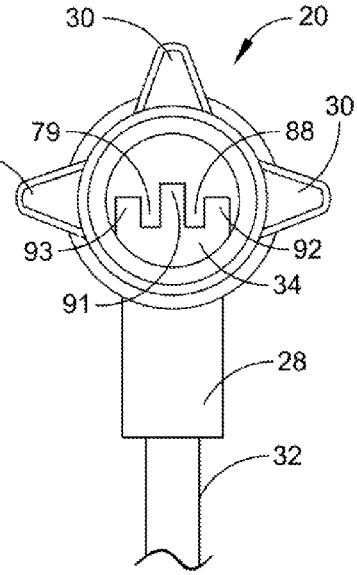
FIG. 2A is a diagrammatic view of the interior wall structure of an in-line mixing unit forming part of the bathing apparatus of FIG. 1.

To facilitate creating the turbulent flow within the mixing unit 20, the mixing unit 20 is provided with a flow disturbance wall 34 (FIG. 2A). The flow disturbance wall 34 is disposed in the water stream path immediately adjacent to the bathing fluid inlet area 28. From the foregoing it should be understood that the flow disturbance wall 34 is disposed at about the inlet for the stream of bathing fluid 14 as it is introduced into the water stream passing through the mixing unit 20. Although in the preferred embodiment of the present invention, the mixing unit 20 has been described with a single flow disturbance wall, it is contemplated that a pair of flow disturbance walls could also be provided, with one wall up stream of the inlet 28 and one wall down stream of the inlet 28 in order to provide a more turbulent flow and mixture of the bathing oil 14 within the stream of water passing through the mixing unit 20.

In summary then, the in-line mixing unit 20 includes a water supply port coupled to the water supply pipe 16, a water discharge port coupled to the showerhead 18, and a bathing fluid input port, coupled to the injection unit 22. The in-line mixing unit 20 further includes a disturbance wall member 34 which has a sufficient height and width configuration to cause water stream turbulences of sufficient force to facilitate lifting and mixing the ejected bathing fluid 14 discharged by the injection unit 22 into the water stream travelling between said water supply pipe 16 and said water dispensing device 18.

Figure 10:
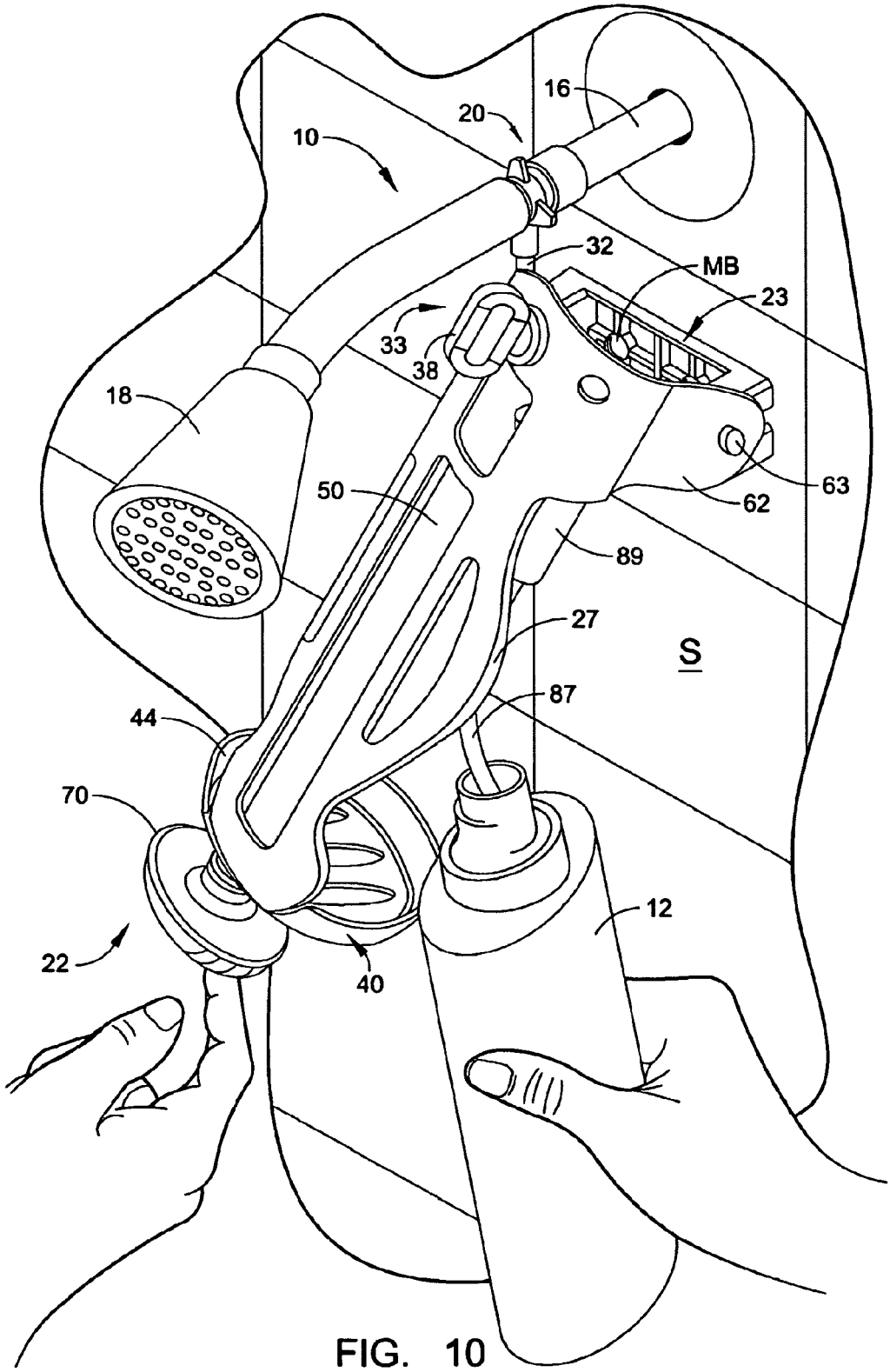
FIG. 10 is a diagrammatic view illustrating the method of providing a source of bathing fluid for the bathing apparatus of FIG. 2.

Considering now the injection unit 22 in greater detail with reference to FIGS. 1-5 and 10, the injection unit 22 is adapted to be pivotally mounted to a wall mount 23 which is installed in close proximity to the water supply pipe 16 and the water dispensing unit 18. This mounting arrangement, as best seen in FIGS. 1 and 10, facilitates the injection unit 22 supplying the in-line mixing unit 20 with a supply of bathing fluid, such as the bathing fluid 14. The connection between the in-line mixing unit 20 and the injection unit 22 takes place via the flexible hose or conduit 32 which defines the outflow path from the injection unit 22 to the mixing unit 20.

In order to transfer the bathing fluid from reservoir 12 into the injection unit 22, the injection unit 22 generally includes: a decorative piston cylinder mount 27 which will be called hereinafter, from time to time, a squid or facade 27; a piston cylinder assembly 29 that is permanently attached to the facade 27; a piston rod actuation handle 70 which is permanently attached to the piston rod 58; a flow control unit or check valve mount 56 (FIG. 8) which is permanently connected to the piston cylinder assembly 29; and a collar 40 which is adapted to support from below the bottle 12 of bathing fluid 14 once it has been introduced into the bathing apparatus 10. For clarity purposes only, for understanding the structure of the present invention, the flow control unit 56 is shown as a separate unit in FIG. 8 as opposed to being permanently attached to the piston cylinder 50.

Figure 8:
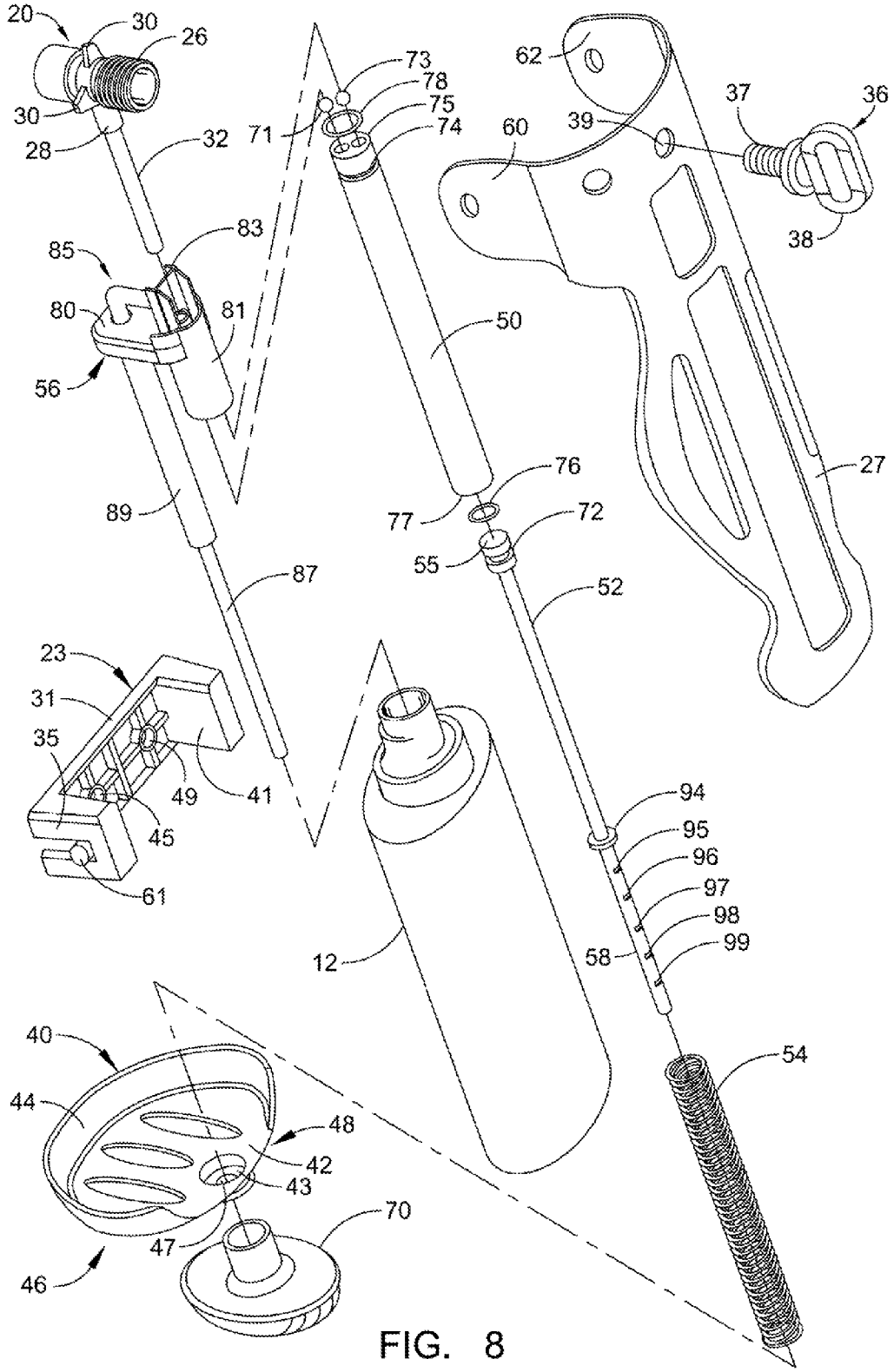
FIG. 8 is an exploded view of the bathing apparatus of FIG. 2.

Considering now the wall mount 23 in greater detail with reference to FIG. 8, the wall mount 23 has a unitary construction with a back wall member 31 with two side wall member 35 and 41 respectively. The side wall member extends perpendicularly to the back wall member and function as mounting wings for the injection unit 22. In this regard, each of the side wall members 35 and 41 are provided with a nipple or pivot pin, such as pivot pins 61 and 63 respectively. The pivot pins 61 and 63 are adapted to be received into and to pivotally support the injection unit 22 as will be explained hereinafter in greater detail. For the moment it will suffice to state that the back wall member has two mounting holes 45 and 49 respectively which mounting holes are adapted to receive therein mounting bolts or screws indicated generally at MB.

Figure 4:
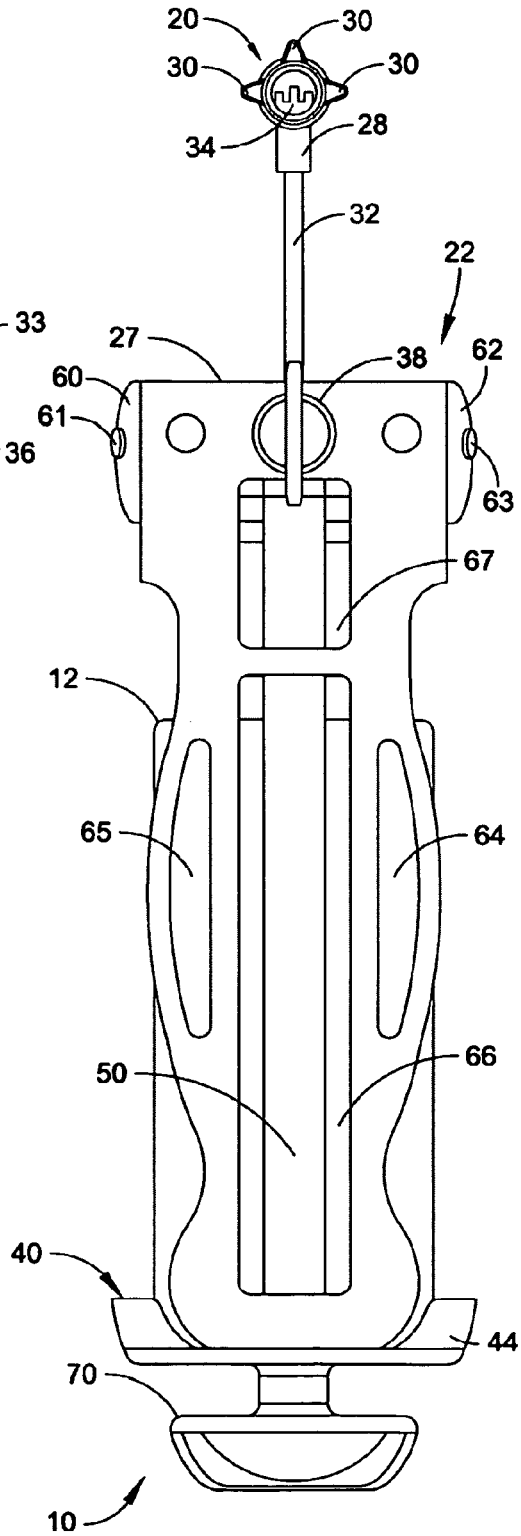
FIG. 4 is a front elevational view of the bathing apparatus of FIG. 2.
Figure 5:
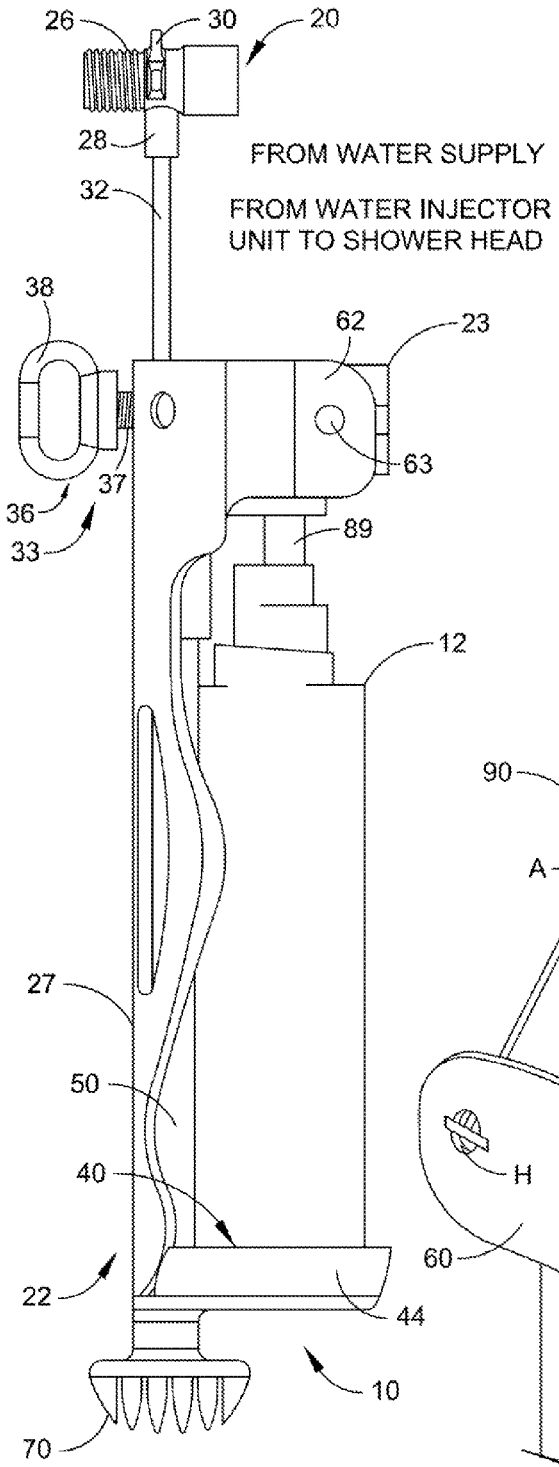
FIG. 5 is a right side elevational view of the bathing apparatus of FIG. 2.

Considering now the decorative piston cylinder mount or facade 27 in greater detail with reference to FIG.S 1-5, the facade 27 is configured in an elongated semi-cylindrical shape with two upper outwardly extending facade wing members indicated generally at 60 and 62 respectively. The wing members 60 and 62 facilitate mounting the facade 27 to the wall mount 23 for pivotal movement. In this regard, each wing member is provided with an aperture for receiving therein a pivot pin, such as the pivot pins 61 and 63 as best seen in FIG. 4. In order to provide the facade 27 with a pleasing appearance the longitudinal walls of the facade 27 are wavy with a series of facade cutouts, such as the cutouts 64-67. The cutouts 64-67 allow a user to clearly see the bottle 12 which is an important feature of the present invention as this allows the user to easily determine the remaining amount of fluid within the bottle without moving the facade 27.

As best seen in FIGS. 1-4, the piston cylinder assembly 29 is mounted permanently to the facade 27. However, for clarity purposes in understanding the structure of the piston cylinder assembly 29, an exploded view of the piston cylinder assembly is shown in FIG. 8, where the piston cylinder assembly is illustrated unattached from the facade 27. As mentioned this is only done for clarity in understanding the structure that will be described hereinafter in greater detail.

Considering now the piston cylinder assembly 29 in greater detail with reference to FIG. 8, the piston cylinder assembly 29 generally includes a piston cylinder 50, a piston rod 52, a spring 54, and a flow control unit 56. The piston cylinder 50 has mounted therein for rectilinear movement, the piston rod 52 which is spring loaded by the spring 54. The piston cylinder 50 has an inlet port 51 (FIG. 9) and an outlet port 53. As will be explained hereinafter in greater detail the inlet port 51 is provided with an inlet ball check valve 57 to control the flow of fluid into the interior of the piston cylinder 50. In a similar manner, the outlet port 53 is provided with an outlet ball check valve 59 which also controls the flow of fluid out of the interior of the piston cylinder 50.

Figure 9:
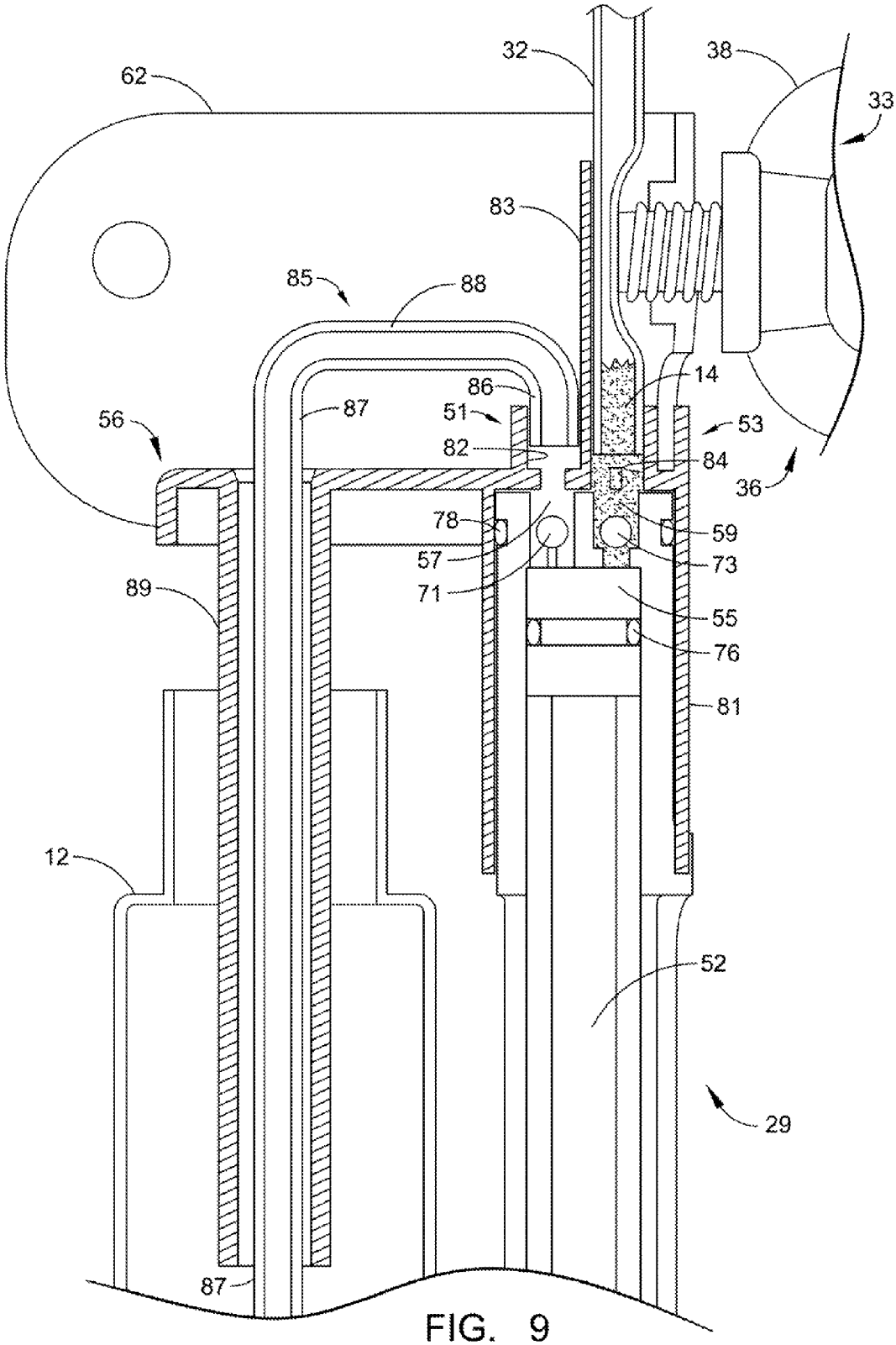
FIG. 9 is a sectional view of the bathing apparatus of FIG. 2.

Considering now the piston cylinder 50 in greater detail with reference to FIGS. 8-9, the piston cylinder 50 has a sufficient diameter for receiving therein the piston rod 52 and the spring 54 which acts against the piston rod 52 to facilitate the pushing of fluid 14 from the interior of the piston cylinder 50. The piston cylinder as best seen in FIG. 8, has a flat top 75 which is provided with two wells or holes indicated generally at 57 and 59 respectively. These are, as mentioned earlier, the piston cylinder fluid inlet port 51 and the piston cylinder fluid outlet port 53. The inlet well 57 and the outlet well 59 are dimensioned for receiving therein check valve balls, indicated generally at 71 and 73 respectively. The check valve balls 71 and 73 are held in their respective wells by the flow control unit 56, as will be explained hereinafter in greater detail. For the moment, it will suffice to state that the outer upper wall of the piston cylinder 50 is provided with an annular O-ring groove 74 for receiving therein a piston cylinder O-ring 78 (FIG. 8) to provide an air tight seal between the piston cylinder 50 and the flow control unit 56. The bottom 77 of the piston cylinder is provided with a centrally disposed aperture (not shown) which is dimensioned for receiving therein the piston rod 52. In this regard, the piston rod 52 has freedom to travel rectilinearly inside and outside the piston cylinder 50 without the loss of fluid. As will be explained hereinafter in greater detail, the piston rod 52 is provided with an annular stop 94 which secures the upper end of the compression spring 94 and is adjustable during manufacture to conform to the characteristics of the spring acquired.

Considering now the piston rod 52 in greater detail with reference to FIGS. 2, 2B, 8 and 9, the piston rod 52 is an elongate solid cylinder like member which has a piston head 55 disposed or attached on one of its ends and more specifically its upper end. The lower or opposite end of the piston rod 52 is provided with the piston actuation pull handle 70 which is affixed to the distal end of the piston rod 52 by a suitable adhesive. It is contemplated that the distal end of the piston rod 52 may also be threaded to be threadably received within the pull handle 70.

Figure 2B:
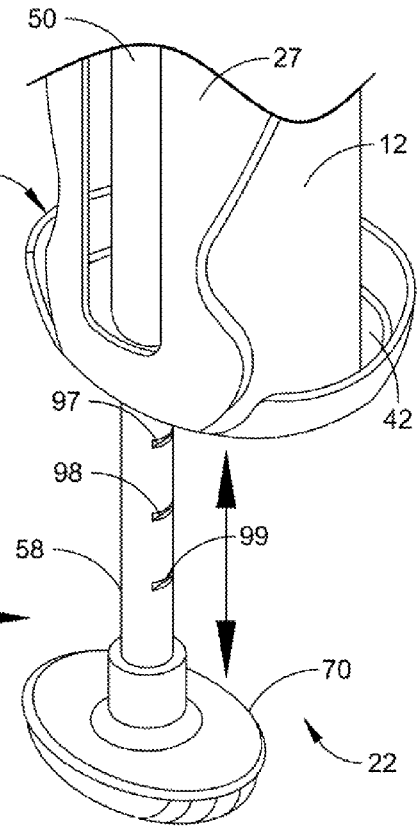
FIG. 2B is an enlarged portion of the bathing apparatus, illustrating its operation for injecting bathing fluid into the in-line mixing unit of FIG. 2A.
Figure 3:
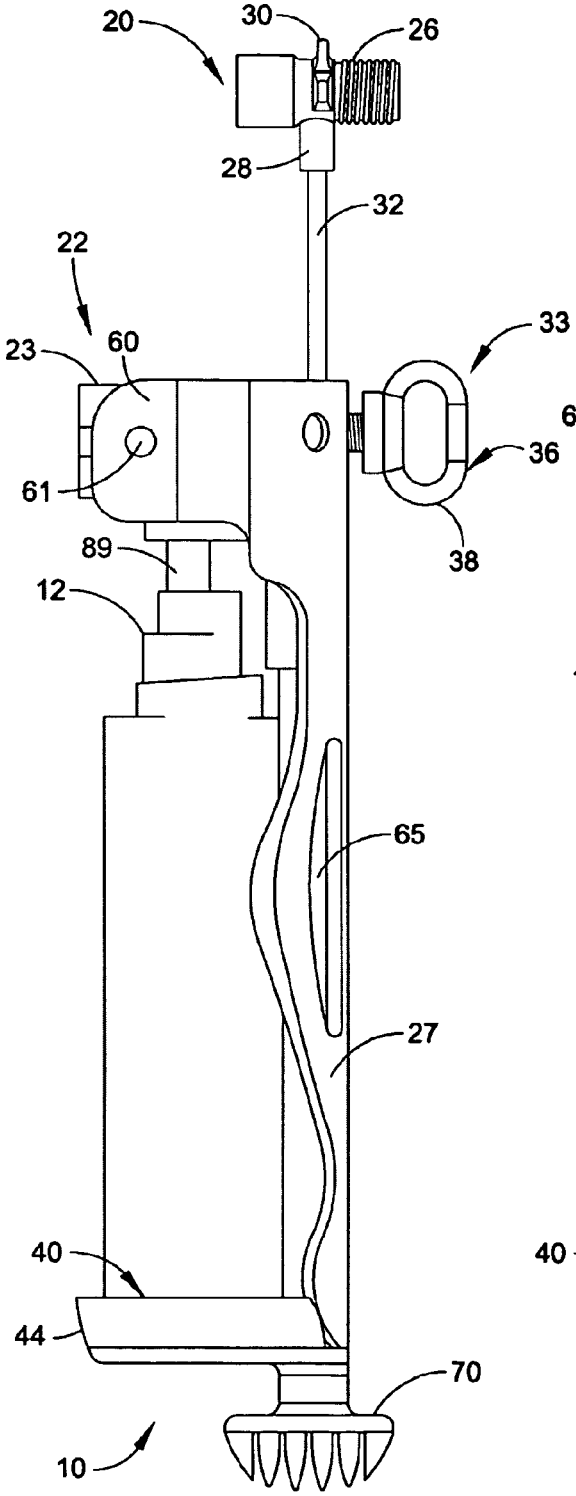
FIG. 3 is a left side elevational view of the bathing apparatus of FIG. 2.

The pull handle 70, as best seen in FIG. 2B enables a user to pull the piston rod 52 downwardly against the spring 54 a sufficient distance to permit the spring to be compressed for driving the piston rod 52 in an opposite or upwardly direction when the user releases the pull handle 70. The lower end of the piston rod 52, indicated generally at 58 (FIG. 8), which is disposed adjacent to the pull handle 70, is provided with a series of spaced apart indicia markings, such as the marking 95-99 respectively. The indicia markings 95-99 provide the user with a visual indication of the amount of fluid that is being drawn into the piston cylinder 50 when the handle 70 is being pulled downwardly. Also the indicia markings provide the user with an indication of the amount of bathing fluid 14 that will be injected into the stream of water flowing to the showerhead 18, when the user releases the pull handle 70.

The piston rod 52 is also provided with an annular stop, indicated generally at 94, which prevents the spring 54 from escaping from the interior of the piston cylinder 50. That is, the spring 54 is captured between the annular stop 94 and the well bottom floor 43. In this regard, the annular stop facilitates spring compression as the piston head 55 is pull downwardly. Without the stop 94, the spring 54 is no longer constrained, which may be preferred with certain spring constructions. It should be understood by those skilled in the art, that the annular stop 94 is positioned on the piston rod 52 in a suitable position on top of the spring 94 to facilitate accommodating variations in spring specifications that directly effect the exerted compression force of the spring 94.

Considering now the piston head 55 in greater detail with reference to FIGS. 8-9, the piston head 55 is provided with an annular groove 72 for receiving therein an O-ring indicated generally at 76 which seals the piston rod 52 to the interior wall of the piston cylinder 50. In this regard, any bathing fluid 14 which enters into the fluid chamber of the piston cylinder 50, which fluid chamber is disposed in the area above the piston head 55, will not be able to leak past the O-ring seal into the lower chamber of the piston cylinder 50, which lower chamber is disposed in the area below the piston head 55. From the foregoing, it should be understood by those skilled in the art, that as the piston head 55 is pulled downward, it allows fluid to be drawn into the fluid chamber via the inlet port 51. Conversely, when the piston head 55 is driven upward under spring force, the fluid 14 drawn into the fluid chamber will be discharged, ejected, or pushed through the outlet port 53 into hose 32.

Considering now the flow control unit 56 in greater detail with reference to FIGS. 8-9, the flow control unit 56 forms part of the piston cylinder assembly 29. The flow control unit 56 generally includes a base member 80 having two downwardly extending channel members of different diameters including a large piston cylinder channel member 81 and a small bottle top channel member 89.

The large or piston cylinder channel member 81 has a sufficient diameter to receive therein in a snug friction tight fit, the piston cylinder 50. In this regard, as mentioned earlier, the piston cylinder O-ring 78 provides a liquid tight seal between the outer wall of the piston cylinder 50 and the inner wall of the flow control unit 56 or more specifically the inner wall of the piston cylinder channel member 81.

The piston cylinder channel member 81 has an inlet 82 and an outlet 84 as best seen in FIG. 9, which inlet 82 and outlet 84 are configured into a check ball valve inlet structure and a check ball valve outlet structure as best seen in FIG. 9. That is, when the flow control unit 56 is permanently attached to the piston cylinder 50, the check valve balls 71 and 73 are captured between the piston cylinder 50 and the flow control unit 56 and function with the provided structure of the flow control unit as an inlet check ball valve and an outlet check ball valve. From the foregoing, those skilled in the art will understand that the inlet check ball valve allows fluid to be drawn into the interior of the piston cylinder 50 but prevents fluid from escaping from the interior of the piston cylinder 50. On the other hand, the outlet check ball valve prevents fluid from flowing into the interior of the piston cylinder 50 and allows fluid to escape from the interior of the piston cylinder 50.

The smaller or bottle top channel member 89 is spaced from the large channel member 81 as sufficient distance to permit a reservoir or a conventional bottle of bathing fluid, such as the bottle 12, to stand in an upright position in a side by side orientation with the piston cylinder assembly 29 as best seen in FIG. 9. The bottle top channel member 89 has a sufficient diameter to be received within the top outlet of the bottle 12 of bathing fluid but in a loose non friction tight fit to facilitate ease in introducing the smaller channel member 89 into the interior of the bottle 12.

The flow control unit 56 also includes an upstanding wall member 83 which is interposed between the inlet 82 and the outlet 84. In this regard, the upstanding wall member 83 helps to provide a support surface for receiving in a friction tight fit an inlet tube 85 which extends between the flow control unit 56 and the bottle 12 via the bottle top channel member 89 as will be explained hereinafter in greater detail. The upstanding wall member 83 also helps to provide a support surface for receiving in a friction tight fit the out let tube or conduit 32 which extends between the flow control unit 56 and the in-line mixing unit 20. It should also be noted, as best seen in FIG. 9, that the upstanding wall member 83 also functions as a stop for the rate control valve 33 as will be explained hereinafter in greater detail.

Considering now the rate control valve 33 in greater detail with reference to FIG. 9, the rate control valve 33 generally includes a finger actuated rate control knob 36 and the stop 83. The rate control knob 36 has an elongate threaded member 37 which is integrally attached to a finger engagable wing member indicated generally at 38. The elongate threaded member 37 is adapted to be threadably received within a rate control aperture 39 (FIG. 8), which forms part of the facade or squid 27. The elongate threaded member 37 has a sufficient length to be received within the facade 27 and to pass there through a sufficient distance to engage the stop 83 for flow rate control purposes as will be explained hereinafter in greater detail.

Considering now the inlet tube 85 in greater detail with reference to FIGS. 8-9, the inlet tube is a composed of a semi rigid plastic material which conforms the inlet tube into a generally U-shape with a short leg member 86 and a long leg member 87. The short leg member 86 is received within the inlet 82 in a friction tight fit between the interior wall of the inlet 82 and the upstanding wall member 83. The long leg member 87 is spaced from the short leg member 86 by a support member or middle member 88 which is sufficient rigid to hold the short leg member 86 and the long leg member 87 in parallel relation to one another. In this regard, the long leg member 87 is sufficiently long to pass through the bottle top channel member 89 and extend downwardly therefrom a sufficient distance to permit its distal end to be in close proximity to the bottom of the bottle 12. From the foregoing those skilled in the art will understand that the inlet tube 85 provides a fluid path from the bottom interior of the bottle 12 to the inlet port of the piston cylinder assembly 29 in order to allow fluid 14 from the interior of the bottle 12 to be drawn by the injection unit 22 into its piston cylinder 50 and then subsequently, discharged or pushed therefrom on user demand through the outlet check valve 59 to the in-line mixing unit 20.

Considering now the outlet hose or conduit 32 in greater detail with reference to FIGS. 8-9, the outlet hose 32 is composed of a semi rigid plastic material that permits the hose 32 to be received in a friction tight fit between the interior wall of the outlet 84 and the upstanding wall member 83. The hose 32 passes between the interior wall of the facade 27 and the outer wall of the upstanding wall member 83 and directly within the path of travel followed by the rate control elongate member 37. In this regard, when the elongate member 37 travels towards the stop 83, the hose 32 is pinched or restricted thereby limiting the flow of fluid 14 that can pass to the in-line mixing unit 20. The further the elongate member 37 travels towards the stop 83, the greater the restricted flow. It should be understood that the hose 32 has a sufficient durability so as not to be pierce or damaged by its interaction with the end of the elongate member 37.

In order to facilitate adequately supporting the bottle 12 of bathing fluid 14 in an upright stable position for daily use by the user, the collar 40 is provided with a collar bottom or base floor 42 (FIG. 8) and an upstanding retaining wall 44. In this regard, the wall is sufficiently tall to stop a wide range of bottles from sliding off the base floor 42 and yet sufficient short to allow ease of loading for larger bottles. (It is contemplated that in a reservoir version with a snap-in-reservoir there would be no need for such a retaining wall 44.) The base floor 42 has a generally circular shape with a sufficient floor area for supporting from below the base area of most, if not all commercially available bottle sizes in which bathing fluid is provided for household use. The upstanding retaining wall 44 extends about three quarters the distance around the outer peripheral boundary of the bottom floor 42 and has a sufficient height and wall thickness to help retain the bottle 12 of bathing fluid 14 on the floor 42 of the collar. A series of three oval shaped, spaced apart, cut-outs indicated generally at 46 (FIG. 8) are disposed in the floor 42 of the collar 40 in order to facilitate the draining of fluid from the collar floor 42. The ovals are perpendicular to the mounting wall and are provided to give the floor a pleasing appearance. The open space in the retaining wall 44 further facilitates the draining of fluid from the floor 42 of the collar 40.

The collar 40 is also provided with an off set piston-cylinder well indicated generally at 48. The well 48 is sufficiently deep and has a sufficient diameter to receive and support therein in a snug friction tight fit a piston cylinder 50 which forms part of the injection unit 22 as will be explained hereinafter in greater detail. In order to make certain the piston cylinder 50 remains fixed within the well 48, an adhesive is applied to the walls of the well 48 and the walls of the piston cylinder 50. The well 48 has a secondary base or well bottom floor 43 which also is generally circular in shape with a sufficient floor area to support from below the piston cylinder 50. Disposed in the center of the well bottom floor 43 is a circular cutout 47 which has a sufficient diameter to allow the free passing there through of the spring loaded piston rod 52 as best seen in FIG. 2B.

Considering now the in-line mixing unit 20 in greater detail with reference to FIG. 2A, the flow disturbance wall 34 is a tooth wall member having a centrally disposed center tooth wall member 91 disposed between a right tooth wall member 92 and a left tooth wall member 93. The center tooth wall member 91 has a sufficient length to extend about half the diameter of the water path of the in-line mixing unit 20, while the right tooth wall member 92 and the left tooth wall member 93 are slightly shorter. Channels indicated generally at 79 and 88 separate the center tooth member 91 from the right tooth wall member 92 and the left tooth wall member 93 respectively. Each of the tooth members 91-93 have sharp pointed corners which cause the stream of water passing through the in-line mixing unit 20 to be disrupted and disturbed violently to create a small but sufficiently strong vacuum or sucking effect to draw bathing fluid 14 into the mixing unit 20 as the bathing fluid 14 is being injected by the piston cylinder injection unit 22. It should be understood that the ejection force of the injection unit 22 is a sufficiently strong pushing force to inject the fluid 14 into the fluid stream of the mixing unit 20 without the vacuum effect of the mixing unit 20. In this regard, the vacuum effect of the mixing unit 20 is supplemental only; but yet, it helps provide a consistent flow of bathing fluid 14 to showerhead 18. In short then, the disturbance wall 34 is disposed at about or adjacent to the fluid input port between the water supply port and the water discharge port and the wall has a sufficient height and width configuration to cause water stream turbulences of sufficient force to facilitate lifting or drawing and mixing the ejected predetermined bathing fluid 14 into the water stream travelling between said water supply pipe 16 and said water dispensing device 18.

Figure 7:
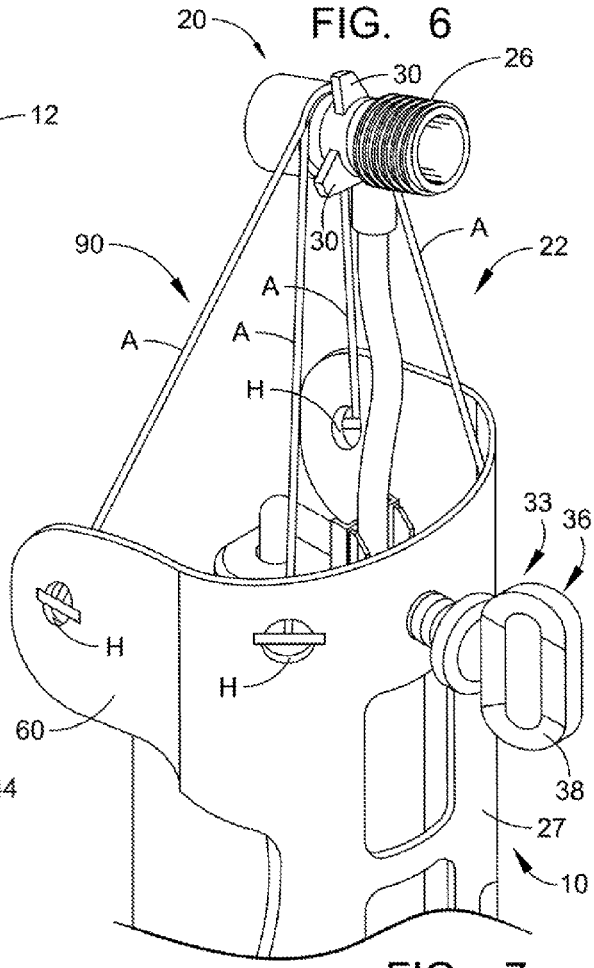
FIG. 7 is a pictorial view illustrating another method of installing the bathing apparatus of FIG. 2 relative to a water supply pipe.

In the preferred embodiment, the bathing apparatus has been described as being installed in a conventional shower stall. However, it is contemplated that the manner in which the bathing apparatus 10 is installed is not limited to a conventional shower stall. In this regard, by the utilization of a lanyard mount, indicated generally at 90 (FIG. 7), the bathing apparatus 10 may be installed in a portable shower or in any other convenient location where there is an extended water pipe to which the bathing apparatus 10 may be attached. In this regard, the lanyard 90 is attached through a set of holes H disposed at the top of the facade 27 by a set of elastic arms, such as an arm A as best seen in FIG. 7. The elastic arms extend from the injection unit 22 to the mixing unit 20 where they are draped over the mixing unit 20 and disposed behind the individual fin or rib members, such as the fin member 30. In this regard, the fin members prevent the elastic arms A from sliding off the mixing unit 20.

In summary then, the invention is a device to be attached to a threaded water pipe 16 for the purpose of mixing a bathing fluid, such as a bath oil 14, into shower water upstream of a showerhead 18 receiving water from the water pipe 16. In this regard, the bathing apparatus 10 has two connected units, the in-line mixing unit 20 and the hand operated injection unit 22. The top or in-line mixing unit 20 is attached between the water pipe 16 and the showerhead 18. The bottom or injection unit 22 is attached to the shower wall or suspended by the lanyard 90 from the top unit 20 or attached directly to the in-line mixing unit as best seen in FIGS. 9 and 1.

In operation, a user after the bathing apparatus has been installed in the shower S, uses the shower apparatus as normal. At anytime during the user taking a shower the user may pull the handle 70 protruding from the bottom of the injection unit 22 downward to a length based on the amount of bathing fluid wanted (visually determined by the indicia markings 95-99, and then release the handle 70 to begin bathing fluid 14 injection. The speed of the injection is controlled by the rate control valve 33 disposed on the front of the injection unit 22, which can and which usually is only set once. Thus, with "hands-free", the user may scrub or smooth on the bathing fluid 14 mixed with water, adjust his or her body position within the showerhead flow applying the bathing fluid where desired and observe the travel of the handle 70 back toward the facade 27 as it returns to its original position indicating how much moisturizer 14 and length of time remains in the current application operation.

In operation, a standard bottle or reservoir 12 of bathing fluid 14 with its lid or cap removed is inserted around the stiff bottle top channel member 89 and inlet tube 87 protruding from the injection unit 22. To assist in this operation, the injection unit 22 may be pivoted upwardly between about 10 degrees and about 90 degrees; however a more preferred range of angle of tilt is between about 20 degrees and 45 degrees. A most preferred angle of tilt is about 30 degrees. The user inserts the channel member 89 and inlet tube 87 into the interior of the bottle 12 so the tube 87 extends to the bottom of the bottle 12. In this regard, the channel member 89 and inlet tube 87 is sufficiently long to secure various standard heights of bottles but short enough for ease of installation. The injection unit 22 is then returned to its upright position with the bottle 12 resting and being supported from below on the collar or shelf of the injection unit 22 so the user can observe the reservoir level within the bottle 12, with transparent walls.

The inlet tube 87 leads to the inlet port 51 of the injection unit 22 and to the inlet port ball check valve 57 which permits the bathing fluid 14 from the bottle 12 to be drawn into the piston cylinder 50 when the piston rod 52 within the piston cylinder 50 is pulled downwardly by the handle 70 against the spring 54. Once the piston cylinder 50 is loaded with a user selected predetermined amount of bathing fluid 14, as determined by the indicia markings 95-99 on the exposed piston rod 52 protruding from the bottom of the injection unit 22, the handle 70 is released, causing the spring 54 to push the piston head 55 and piston rod 52 upwardly, closing the inlet port check valve 57 leading to the bottle 12 and opening the outlet port ball check valve 59 to cause the bathing fluid 14 drawn within the interior of the piston cylinder 50 to be pushed out the outlet port 53 leading to the in-line mixing unit 20. The fluid communication passage between the outlet port 53 and the in-line mixing unit 20 has interposed therebetween the speed or rate control valve 33 that restricts the flow of bathing fluid 14 passing to the in-line mixing unit 20. The fluid 14 passing from the injection unit 22 is injected into the stream of water passing between the water pipe 16 and the showerhead 18, thereby permitting the disturbance wall 34 within the mixing unit 20 to assist in causing the bathing fluid 14 to be mixed with the stream of water upstream of the showerhead 18.

Based on the foregoing the following unique advantages are realized by the present invention:

The disclosed bathing apparatus 10 does not rely on "venturi", suction or pressure from the restriction of water flow to power the injection, instead the bathing apparatus 10 uses a steady flowing pump action.

After a simple linear motion by the user, the bathing apparatus 10 injects and mixes a measured amount of moisturizer at a steady and controlled rate into the water flow with a consistent concentration over the period of the injection leaving the hands of the user free and allowing the user to move freely within the shower stream without the need of further touching the bathing apparatus 10.

The disclosed bathing apparatus 10 facilitates providing bathing fluid 14 in a sterile container or bottle 12 in which the moisturizer 14 was purchased accommodating a broad range of bottle sizes. This device 10 uses a simple and easy "tilt, up and in" installation of the reservoir (bottle 12) with no need to screw on any lids to ensure an air-tight fit with the reservoir 12. In this regard, the reservoir 12 has access to the atmosphere.

The disclosed bathing apparatus 10 easily and accurately measures the amount and speed of moisturizer injected by observing and using the calibration on the side of the piston-rod 52 when the handle 70 is pulled just before the injection begins. The user can easily alter the measured amount by controlling the length of the piston rod pulled downwardly and can easily set the speed of injection with a simple twist of the rate control valve 33.

While a particular embodiment of the present invention has been disclosed, it is to be understood that various different modifications are possible and are contemplated within the true spirit and scope of the appended claims. For example, the wall mount 23 is described herein as being mounted by mounting bolts or screws MB. It is contemplated that the wall mount may also be secured by utilizing 2-sided water proof adhesive tape. As another example, different size piston springs, such as the spring 54 may be utilized to provide different injection forces. In this regard, the location of the stop 94 which rest at the top of the spring 54 may be adjusted as required to accommodate the different size springs. As still another example, it is contemplated that the bathing apparatus 10 can be provided with a custom fitted open-top reservoir to maximize space but till maintain the key loading characteristics of the device. Therefore, there is no intention, therefore, of limitations to the exact abstract or disclosure herein presented.

I claim:

1. A bathing apparatus comprising:

a flow disturbance wall disposed in an in-line mixing unit;

said flow disturbance wall being positioned within a water flow path extending between a water supply pipe and a water dispensing device for helping to facilitate the mixing of bathing fluid within the water flow path; and a hand operated injection unit adapted to be mounted spaced from said flow disturbance wall, said hand operated injection unit having flow control means for providing said in-line mixing unit at about said flow disturbance wall with a predetermined quantity of bathing fluid at a user selected rate of discharge over a user selected period of time;

wherein said in-line mixing unit is a three port turbulent flow mixing unit, said mixing unit including:

an elongate conduit for defining said water path;

another elongate conduit for defining a bathing fluid inlet area, said inlet area being disposed between a bathing fluid input port and said water path; and wherein said flow disturbance wall is disposed upstream of said bathing fluid inlet area in said water path, said flow disturbance wall having a sufficient height and width configuration to cause a stream of water passing along said water path to be disrupted violently creating a sufficiently strong vacuum effect to draw bathing fluid in said inlet area into said water path for bathing fluid mixing purposes.

2. A bathing apparatus comprising:

a flow disturbance wall disposed in an in-line mixing unit;

said flow disturbance wall being positioned within a water flow path extending between a water supply pipe and a water dispensing device for helping to facilitate the mixing of bathing fluid within the water flow path; and a hand operated injection unit adapted to be mounted spaced from said flow disturbance wall, said hand operated injection unit having flow control means for providing said in-line mixing unit at about said flow disturbance wall with a predetermined quantity of bathing fluid at a user selected rate of discharge over a user selected period of time;

wherein said flow disturbance wall is a tooth wall member having a centrally disposed center tooth wall member disposed between a right tooth wall member and a left tooth wall member;

said center tooth wall member having a sufficient length to extend about half the diameter of said water path, said right tooth wall member and said left tooth wall member each having a short length than said center tooth wall member; and wherein said center tooth member is separated from said right tooth wall member and said left tooth wall member by a right channel and a left channel respectively;

wherein each respective tooth member is configured with sharp pointed corners to cause water passing over said wall members to be sufficiently disrupted and disturbed violently for creating a sufficiently strong vacuum at said inlet area to draw bathing fluid in said inlet area into said water path for water bathing fluid mixing purposes.

3. A bathing apparatus comprising:

an in-line mixing unit coupled between a water supply pipe and a water dispensing device; and a hand operated injection unit for forcing a quantity of a bathing fluid to be delivered to said in-line mixing unit;

wherein the quantity of bathing fluid is a user selected predetermined quantity of bathing fluid;

wherein said injection unit includes:

a piston cylinder having an input port for enabling said cylinder to be filled with the user predetermined quantity of bathing fluid upon user demand and an output port for enabling said cylinder to eject the user predetermined quantity of bathing fluid at an ejection rate determined by a user;

a piston disposed within said cylinder to draw into said cylinder upon user demand the user predetermined quantity of bathing fluid and to eject fluid within said cylinder upon user demand the predetermined quantity of bathing fluid; and a piston rod coupled between said piston and a hand operated handle disposed outside of said cylinder, wherein said hand operated handle enables a user upon demand to displace said piston a sufficient distance within said cylinder to draw the predetermined quantity of bathing fluid into said cylinder; and a compression spring disposed within said cylinder for exerting upon said piston when it is displaced said sufficient distance a sufficient force to move said piston to cause the predetermined quantity of bathing fluid to be ejected from said cylinder via said output port;

wherein said piston rod has a sufficient length dimension to extend outside of said cylinder to facilitate coupling said piston rod between said piston and said hand operated handle; and wherein said piston rod is marked with a plurality of spaced apart load indicia to provide the user with a visual indication of a plurality of piston loads; and wherein said plurality of piston loads are indicative of different quantities of bathing fluid including the predetermined quantity of bathing fluid.

4. The bathing apparatus according to claim 3, wherein said input port is provided with an inflow check valve to close said input port when said piston is moved under spring force to eject the predetermined quantity of bathing fluid from within said cylinder.

5. The bathing apparatus according to claim 4, wherein said output port is provided with an outflow check valve to open said output port when said piston is moved under spring force to eject the predetermined quantity of bathing fluid from within said cylinder.

6. The bathing apparatus according to claim 5, wherein said cylinder and said mixing unit are in fluid communication with one another when said outflow check valve causes said output port to open for bathing fluid ejecting purposes.

7. The bathing apparatus according to claim 6, wherein said mixing unit includes a water supply port, a water discharge port and a fluid input port.

8. The bathing apparatus according to claim 7, wherein said fluid input port has coupled thereto an elongated conduit member;

wherein said conduit member has a sufficient length to be coupled to the output port of said cylinder.

9. The bathing apparatus according to claim 7, wherein mixing unit includes a wall member disposed upstream of said fluid input port between said water supply port and said water discharge port;

wherein said wall has a sufficient height configuration to cause water stream turbulences of sufficient force to facilitate lifting and mixing the ejected predetermined bathing fluid into the water stream travelling between said water supply pipe and said water dispensing device.

10. The bathing apparatus according to claim 9, conduit member has coupled thereto a rate control valve to further establish the flow rate for the delivery of the predetermined quantity of bathing fluid between said cylinder and said water dispensing device.

11. The bathing apparatus according to claim 10, further comprising:

a retaining arrangement for supporting from below a reservoir of bathing fluid and for placing the reservoir of bathing fluid in fluid communication with the input port of said cylinder.

12. The bathing apparatus according to claim 11, wherein said retaining arrangement includes:

an elongated channel member adapted to be received within said reservoir of bathing fluid to facilitate extending a flexible hose from a bottom portion of the reservoir of bathing fluid to said input port;

wherein said elongated channel member further helps to secure said reservoir in an upright position relative to said ejection unit.

13. The bathing apparatus according to claim 12, wherein said retaining arrangement further includes a shelf for receiving thereon the reservoir of bathing fluid, said shelf having an upwardly extending lip for helping to retain the reservoir of bathing fluid on said shelf.

14. The bathing apparatus according to claim 12, wherein said water dispensing device is a shower head.

15. A method of using a bathing apparatus, comprising the steps of:

providing a mixing unit to cause a stream of water traveling from a water supply pipe to a water dispensing unit to be violently and randomly disturbed by a turbulent flow;

providing a bottle retaining unit having an elongated-fluid channel, wherein the bottle retaining unit is adapted to support from below an open bottle of bathing fluid provided in a plurality of different bottle sizes;

providing a hand operated bathing fluid injecting unit;

coupling said hand operated bathing fluid injecting unit to said mixing unit to place them in fluid communication with one another;

coupling said hand operated bathing fluid injecting unit to said bottle retaining unit to place them in fluid communication with one another;

tilting said bottle retaining unit upwardly a sufficient distance to permit said elongated fluid channel to be received within the open bottle of bathing fluid;

returning said bottle retaining unit to an upright position to help secure the open bottle of bathing fluid in an upright position and to support from below the open bottle of bathing fluid;

pulling an actuation handle disposed oh said hand operated bathing fluid injecting unit with sufficient force to cause a predetermined quantity of bathing fluid to be drawn from said open bottle of bathing fluid into said bathing fluid injecting unit; and releasing said actuation handle for hands free discharge from said injecting unit, at a user select flow rate, a predetermined quantity of bathing fluid to forcefully flow to said mixing unit for delivery to said water dispensing unit.

16. A bathing apparatus, comprising:

an elongate conduit for defining a water path, said conduit having an input port for receiving water under pressure and an output port adapted to be coupled to a water dispensing device;

another elongate conduit further having an inlet area disposed downstream of said input port for facilitating the introduction of a stream of bathing fluid into said water path;

turbulent flow means disposed in said water path immediately adjacent to said inlet area for causing water stream turbulences at about said inlet area of sufficient force to facilitate pulling the bathing fluid in said inlet area into said water path for fluid mixing purposes; and hand operated injecting means coupled to said conduit at about said inlet area for injecting into said inlet area a user selected quantity of bathing fluid;

wherein said turbulent flow means has a sufficient height and width configuration at about said inlet area to cause water stream turbulences of sufficient force to facilitate drawing and mixing the bathing fluid injected into said inlet area into said water path but not a sufficient venturi suction effect to override a steady flowing pump action of said injecting means.

17. The bathing apparatus according to claim 16, wherein said hand operated injecting means includes a rate control valve for establishing a flow rate for the delivery of the bathing fluid.

18. The bathing apparatus according to claim 17, wherein the bathing fluid is provided from a reservoir of bathing fluid selected from a group of bathing fluids including moisturizer liquid, hydrating fluid, soap, bathing oil, shampoo, hair conditioner, and hair rinse.

19. A bathing apparatus, comprising:

an elongate conduit for defining a water path, said conduit having an input port for receiving water under pressure and an output port adapted to be coupled to a water dispensing device;

another elongate conduit further having an inlet area disposed downstream of said input port for facilitating the introduction of a stream of bathing fluid into said water path;

turbulent flow means disposed in said water path immediately adjacent to said inlet area for causing water stream turbulences at about said inlet area of sufficient force to facilitate pulling the bathing fluid in said inlet area into said water path for fluid, mixing purposes; and hand operated injecting means coupled to said conduit at about said inlet area for injecting into said inlet area a user selected quantity of bathing fluid;

wherein said turbulent flow means is a pair of flow disturbance walls, wherein one wall of said pair of walls is up stream of said inlet area and wherein the other wall of said pair of walls is down stream of said inlet area to provide a more turbulent flow and mixture of bathing fluid within said water path.

20. A bathing apparatus, comprising:

a Tee coupler for defining two fluid paths, wherein one of the two fluid paths is a water path between a source of water under pressure and a water dispensing device and wherein another one of the two fluid paths is a bathing fluid path between a source of bathing fluid under pressure and said water path; and said Tee coupler having an inlet area disposed in said bathing fluid path and in fluid communication with said water path and an upstream disturbance wall at about said inlet area;

said disturbance wall having a sufficient height and width configuration to cause a stream of water travelling along said water path to be sufficiently disturbed to create a vacuum effect at about said inlet area to facilitate drawing bathing fluid from said inlet area into said water path for mixing bathing fluid with the water travelling along said water path.

21. The bathing apparatus according to claim 20, further comprising:

bathing fluid injection means coupled to said Tee coupler for supplying a stream of bathing fluid to said inlet area; said stream of bathing fluid being a user controlled stream having a user selected predetermined quantity of bathing fluid dispensed at a user selected predetermined rate over a user selected predetermined period of time.

22. A bathing apparatus for mixing bathing fluid into a stream of water being discharged from a water dispensing device, the apparatus comprising:

a wall mount for supporting from below and in close proximity to the water dispensing device a bathing fluid injection unit, said injection unit being adapted to be connected in fluid communication with a replaceable reservoir of bathing fluid supported from below by said wall mount;

wherein said injection unit is further adapted to be connected in fluid communication with a bathing fluid path for receiving bathing fluid injected from said injection unit, said bathing fluid path having applied thereto a sufficiently strong vacuum effect created upstream from the stream of water being discharged from the water dispensing device to assist with drawing the injected bathing fluid along the bathing fluid path and into the stream of water being discharged from the water dispensing device for bathing fluid mixing purposes but not a sufficiently strong vacuum effect to override a constant pumping action of said injection unit.

23. The bathing apparatus according to claim 22, further comprising:

a pair of intersecting conduits, wherein one of said pair of intersecting conduits defines a water path from a source of water under pressure to said water dispensing device and wherein another one of said pair of intersecting conduits defines said fluid path; and wherein said bathing fluid injection unit includes:

a piston cylinder having an input port for enabling said cylinder to be filled with the user predetermined quantity of bathing fluid upon user demand and an output port for enabling said cylinder to eject the user predetermined quantity of bathing fluid at an ejection rate determined by a user;

a piston disposed within said cylinder to draw into said cylinder upon user demand the user predetermined quantity of bathing fluid and to eject from within said cylinder upon user demand the predetermined quantity of bathing fluid; and a piston rod coupled between said piston and a hand operated handle disposed outside of said cylinder, wherein said hand operated handle enables a user upon demand to displace said piston a sufficient distance within said cylinder to draw the predetermined quantity of bathing fluid into said cylinder; and a compression spring disposed within said cylinder for exerting upon said piston when it is displaced said sufficient distance a sufficient force to move said piston to cause the predetermined quantity of bathing fluid to be ejected from said cylinder via said output port.

* * * * *